United States Patent [19]

Hackett

[11] 4,341,106

[45] Jul. 27, 1982

[54] APPARATUS FOR CONTROLLING THE MOVEMENT OF A RECIPROCATORY HYDRAULICALLY DRIVEN ELEMENT OF A METAL FORMING MACHINE

[75] Inventor: Kenneth P. Hackett, Nashville, Tenn.

[73] Assignee: Gleason Works, Rochester, N.Y.

[21] Appl. No.: 90,665

[22] Filed: Nov. 2, 1979

Related U.S. Application Data

[62] Division of Ser. No. 787,056, Apr. 13, 1977, Pat. No. 4,197,757.

[51] Int. Cl.[3] ..... B21C 23/08; B21C 27/00; F16B 15/08

[52] U.S. Cl. ..... 72/453.07; 72/264

[58] Field of Search ..... 72/453.07, 453.01, 453.18, 72/253, 60, 264, 267, 28, 344, 345, 353, 354, 271, 272, 256; 29/1.2, 1.3, 1.31; 91/394, 441

[56] References Cited

U.S. PATENT DOCUMENTS

| | | | |
|---|---|---|---|
| 208,524 | 10/1878 | Johnson | 308/237 R |
| 536,278 | 3/1895 | Friedrich | 72/343 |
| 639,299 | 12/1899 | Sharp | 72/354 |
| 1,314,037 | 8/1919 | Amberg | 72/255 |
| 1,819,254 | 8/1931 | Mantle | 72/256 |
| 1,934,652 | 11/1933 | Anderson | 72/266 |
| 2,140,775 | 12/1938 | Talbot-Crosbie | 76/107 R |
| 2,168,641 | 8/1939 | Arbogast | 72/354 |
| 2,237,993 | 4/1941 | Korbuly | 72/266 |
| 2,302,115 | 11/1942 | Gazey | 72/354 |
| 2,581,434 | 1/1952 | Nowak | 91/441 |
| 2,586,336 | 2/1952 | Huck | 72/354 |
| 2,621,344 | 12/1952 | Friedman | 72/354 |
| 2,812,059 | 11/1957 | Biginelli | 72/354 |
| 2,878,562 | 3/1959 | Bruce | 29/552.4 |
| 2,893,553 | 7/1959 | Kreidler | 29/157 R |
| 3,078,566 | 2/1963 | Egan | 29/534 |
| 3,096,579 | 7/1963 | Waller | 29/534 |
| 3,120,769 | 2/1964 | Hatebur | 72/354 |
| 3,138,257 | 6/1964 | Andersen | 72/354 |
| 3,146,678 | 9/1964 | Strick | 91/394 |
| 3,165,199 | 1/1965 | Tlaker | 72/354 |
| 3,175,725 | 3/1965 | Sampson | 91/394 |
| 3,186,209 | 6/1965 | Friedman | 72/356 |
| 3,187,402 | 6/1965 | Duffield | 29/1.3 |
| 3,197,857 | 8/1965 | Nippert | 72/265 |
| 3,213,664 | 10/1965 | Putetti | 72/343 |
| 3,280,613 | 10/1966 | Schrom | 72/344 |
| 3,283,556 | 11/1966 | Putetti | 72/343 |
| 3,333,455 | 8/1967 | Ratte | 72/354 |
| 3,353,394 | 11/1967 | Smith | 72/347 |
| 3,370,450 | 2/1968 | Scheucher | 72/354 |
| 3,391,561 | 7/1968 | Calmes | 72/209 |
| 3,417,597 | 12/1968 | Napoli | 72/377 |
| 3,434,326 | 3/1969 | Serret | 72/354 |
| 3,476,911 | 11/1969 | Bachmann | 219/151 |
| 3,484,806 | 12/1969 | Huddleston | 72/DIG. 31 |
| 3,487,196 | 12/1969 | Bachmann | 219/151 |
| 3,564,894 | 2/1971 | Sharon | 72/344 |
| 3,631,706 | 1/1972 | Archer | 72/354 |
| 3,719,068 | 3/1973 | Hashimoto | 72/254 |
| 3,731,516 | 5/1973 | Dohmann | 72/354 |
| 3,761,257 | 9/1973 | Dunn | 75/208 R |
| 3,765,218 | 10/1973 | Poulson | 72/354 |
| 3,771,221 | 11/1973 | Bachmann | 72/60 |
| 3,792,644 | 2/1974 | Ferguson | 91/394 |
| 3,835,686 | 9/1974 | Lawson | 72/354 |
| 3,861,192 | 1/1975 | Suzuki | 72/273 |
| 3,871,200 | 3/1975 | Onoda | 29/420.5 |
| 3,893,325 | 7/1975 | Sato | 72/344 |
| 3,899,912 | 8/1975 | Orain | 72/354 |
| 3,962,899 | 6/1976 | Hubbell | 72/334 |
| 4,173,162 | 11/1979 | Shaughnessy | 91/394 |

FOREIGN PATENT DOCUMENTS

| | | | |
|---|---|---|---|
| 1527468 | 8/1969 | Fed. Rep. of Germany | 72/354 |
| 2347050 | 3/1975 | Fed. Rep. of Germany | 72/453.07 |
| 279977 | 4/1952 | Switzerland | 72/256 |
| 1107871 | 3/1968 | United Kingdom | 72/271 |

OTHER PUBLICATIONS

"The Extrusion of Metals" by Pearson & Parkins, 2nd Edition, (1960), pp. 320 & 321.

*Primary Examiner*—Gene P. Crosby

*Attorney, Agent, or Firm*—Luedeka & Fitch

[57] ABSTRACT

A method and apparatus are provided for controlling the movement of a reciprocatory hydraulically driven element of a metal forming machine between extended and retracted positions. Two piston members, having different sized working areas are slidably mounted in two reservoirs which are in communication with one another at a location other than their respective inlets. The system provides fast and slow movement of the element utilizing a single source of pressurized hydraulic fluid.

4 Claims, 12 Drawing Figures

APPARATUS FOR CONTROLLING THE MOVEMENT OF A RECIPROCATORY HYDRAULICALLY DRIVEN ELEMENT OF A METAL FORMING MACHINE

This application is a division of copending application Ser. No. 787,056, filed Apr. 13, 1977, now U.S. Pat. No. 4,197,757, issued Apr. 15, 1980, entitled "Method and Apparatus for the Cold Forming of Metal."

This invention relates to metal forming machines, and particularly to control of machines for the cold forming of metal employing a reciprocatory hydraulically driven element.

Backward and/or forward extrusion of metals, without heating the metal prior to its being formed, are well known in the art. Such metal forming operations, however, suffer from several disadvantages, among which are the problems of tool breakage and limitations upon the cross-sectional dimensions of the part which can be formed from a given metal billet. These and other metal forming operations also frequently are slow in cycling, hence are unduly costly.

In a typical extrusion operation, a metal billet is held within a die cavity. A punch or anvil is inserted in the die cavity to define an annular space therebetween and held stationary while the billet is forced to extrude over and about the anvil, resulting in extrusion of the billet into and then out of the annular space between the die cavity and the anvil. In other embodiments, the anvil is itself moved relative to a stationary die cavity with resultant extrusion of the billet out of the die cavity through the annular space between the anvil and the die cavity wall.

It has been recognized heretofore that tool breakage, particularly breakage of the anvil, is likely if there is misalignment of the anvil with respect to the die cavity by as much as 0.0005 inch, per inch, for example. Such misalignment can occur due to "wobble" of the anvil and/or can be caused by defects in the metal billet, etc. For example, hard spots in the billet and/or air inclusions can result in anvil misalignment sufficient to cause breaking of the anvil. As a consequence of these and other factors, relative movement of the machine elements has been purposely slow and precise.

In certain prior art extrusion operations, in order to utilize a starting billet that has a minimum cross-sectional area (thereby realizing the necessary economies associated with the choice of extrusion as the forming method), the extrusion process has included multiple steps wherein the billet is reduced, i.e. extruded, a multiplicity of times, each successive extrusion enlarging the diameter of the product by an amount that is within the heretofore acceptable reduction limit. Obviously, these multiple "hit" operations increase the cost of the process, thereby increasing the cost of the resultant product.

The present inventor has found that reductions in excess of one hundred twelve (112%) percent can be obtained, using only a single "hit", thereby opening up the availability of the less expensive cold extrusion forming process to the manufacture of products not heretofore possible. This is accomplished in a single "hit" operation, by establishing and maintaining a force against the extruding billet which is in opposite to the extruding force, thereby controlling the flow of the metal in the course of the extrusion. It has been found that the opposing force applied to the extruding product appears to rigidify the product with respect to the extrusion apparatus such that the extruding product which is relatively rigidly held at one end within the annular space between the anvil and the die cavity and at its opposite outboard end by a member which is applying the extrusion-opposition force to the product as it is being formed, appears to function as a lateral support sleeve for the anvil about which the billet is extruding. Tool breakage has been reduced by the present inventors to a negligible factor, even at production rates of between 30 and 40 products per minute. Further, the product exhibits excellent physical properties including good dimensional tolerances.

It is therefore an object of the present invention to provide an improved system for controlling the movement of a reciprocatory hydraulically driven element of a metal forming machine. Other objects and/or advantages of the invention will be recognized from the following description and claims, including the drawings in which:

FIGS. 1–3 are fragmentary representations, partly in section, of the sequence of operation of one embodiment of apparatus embodying various features of the invention;

FIGS. 4*a*, 4*b* and 4*c*, collectively, comprise a fragmentary top view, part in section and part cutaway, of one embodiment of apparatus embodying various features of the invention and showing the apparatus in its open position for tool change;

Figure 1:
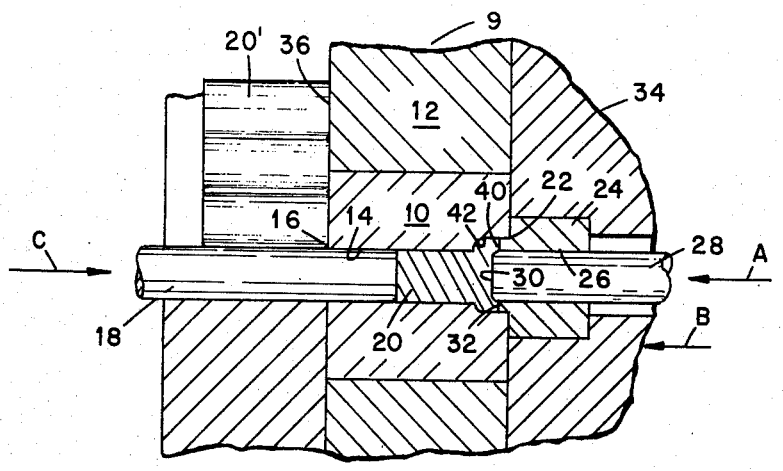
Figure 2:
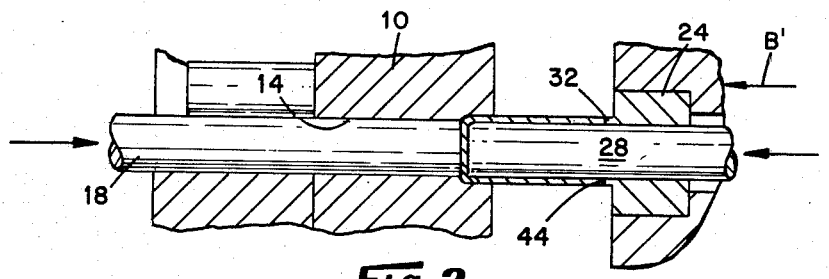
Figure 3:
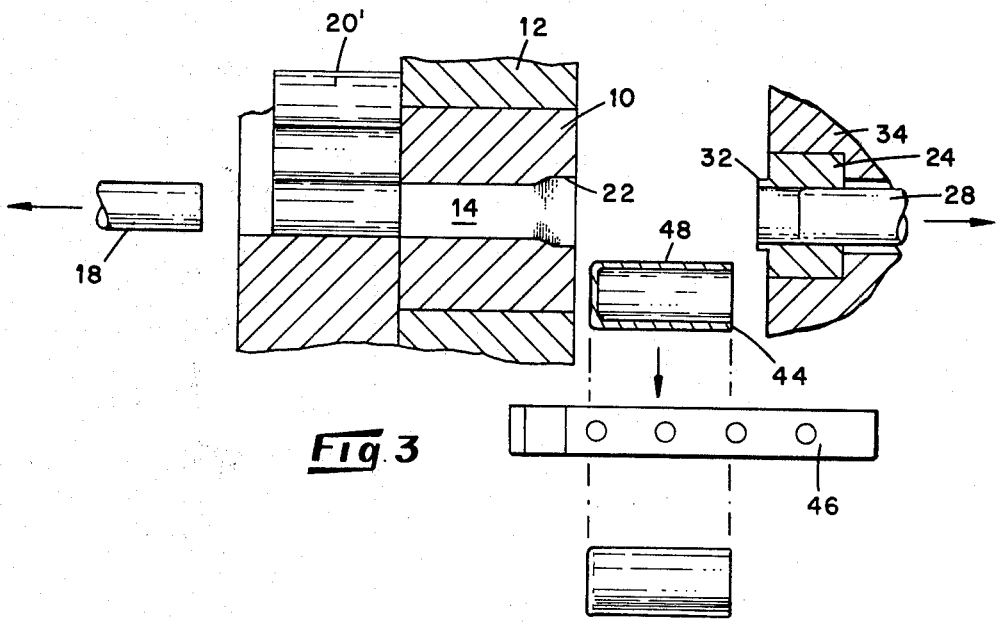

Referring now to the Figures, in FIGS. 1–3, there is schematically depicted the sequence of operation of one embodiment of the apparatus of the present invention. The representations in these Figures also schematically depict the steps of the method employed. Specifically, in the embodiment depicted in FIGS. 1–3, there is provided a tool stack 9 comprising a die nib 10 surrounded by a shrink ring 12. The die nib 10 defines a cavity 14 within one end 16 of which there is reciprocatably disposed a ram 18 which closes the end 16 of the cavity 14. A metal billet 20 is disposed within the cavity 14 and the opposite end 22 of the cavity is closed by a power pad means 24 comprising a sleeve defining an axial bore 26. Within the bore 26 there is reciprocatably disposed an anvil 28. The power pad 24 is provided with an annular shoulder 32 adapted to be received within the end 22 of the cavity such that this shoulder 32 and the leading end 30 of the anvil 28 close the end 22 of the die cavity 14. Collar means 34 is provided in surrounding relationship to the power pad 24 and as will be further seen hereinafter provides for the controlled application of pressure to the power pad to selectively adjust its position relative to the die nib 10 and the engagement of the shoulder 32 with the extrusion product.

In FIG. 1 there is schematically depicted a magazine 36 within which there is received a plurality of metal billets 20' in position to be disposed successively within the die cavity 14 as will be further described hereinafter.

In the embodiment of FIG. 1, the anvil 28 is positioned and maintained stationary by a first force represented by the arrow A. Further, the power pad 24 is moved into its position closing the annular space 40 between the anvil 28 and the internal wall 42 of the die cavity 14 by a force represented by the arrow B. Further, in FIG. 1, the ram is shown as having commenced an extrusion operation by reason of a force, represented by the arrow C, being applied to the ram to urge the billet into the annular space 40 between the anvil 28 and the die cavity wall 42.

In FIG. 2, the ram 18 has been moved further into the die cavity 14 such that the billet has been extruded partly about the anvil 28. It is noted that the annular shoulder 32 of the power pad 24 is maintained in contact with, and urged against, the outboard end 44 of the extruded billet, the engagement between the shoulder 32 and the end 44 of the billet being maintained by a force, represented by the arrow B', applied to the collar 34 which in turn transmits the force to the power pad 24. In the course of the extrusion the force upon the power pad is adjusted to a value less than the extrusion pressure, but kept to a relatively high value and in opposition to the extrusion pressure.

Upon completion of the extrusion operation, as seen in FIG. 3, the power pad 24 is in a retracted position relative to the die nib 10, the ram 18 is retracted, and the anvil 28 is retracted to cause the extruded product 48 to drop by gravity through a detector 46 whose function will be referred to hereinafter. Thereafter, the apparatus is ready to commence a further operational cycle.

Figure 4A:
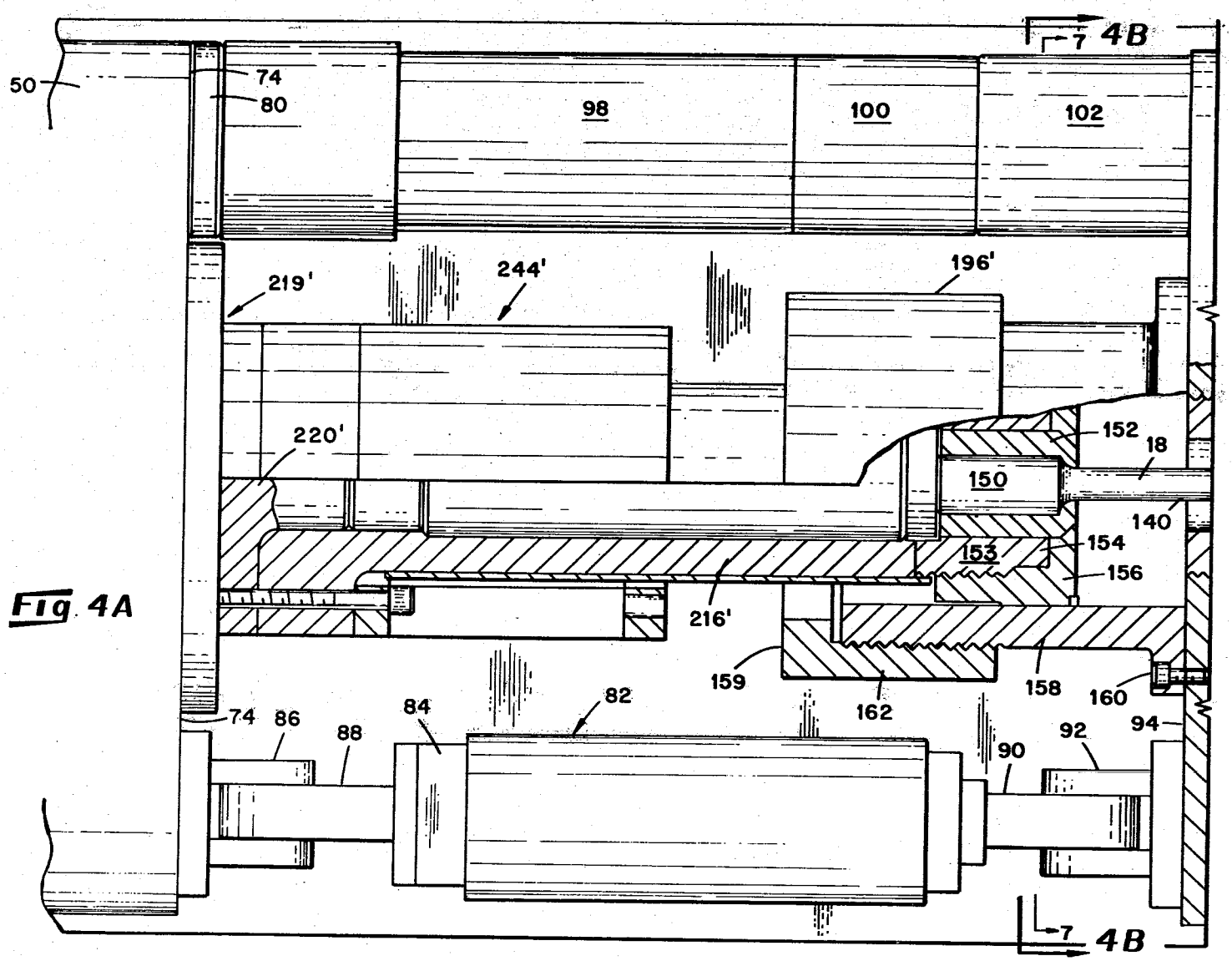
Figure 4B:
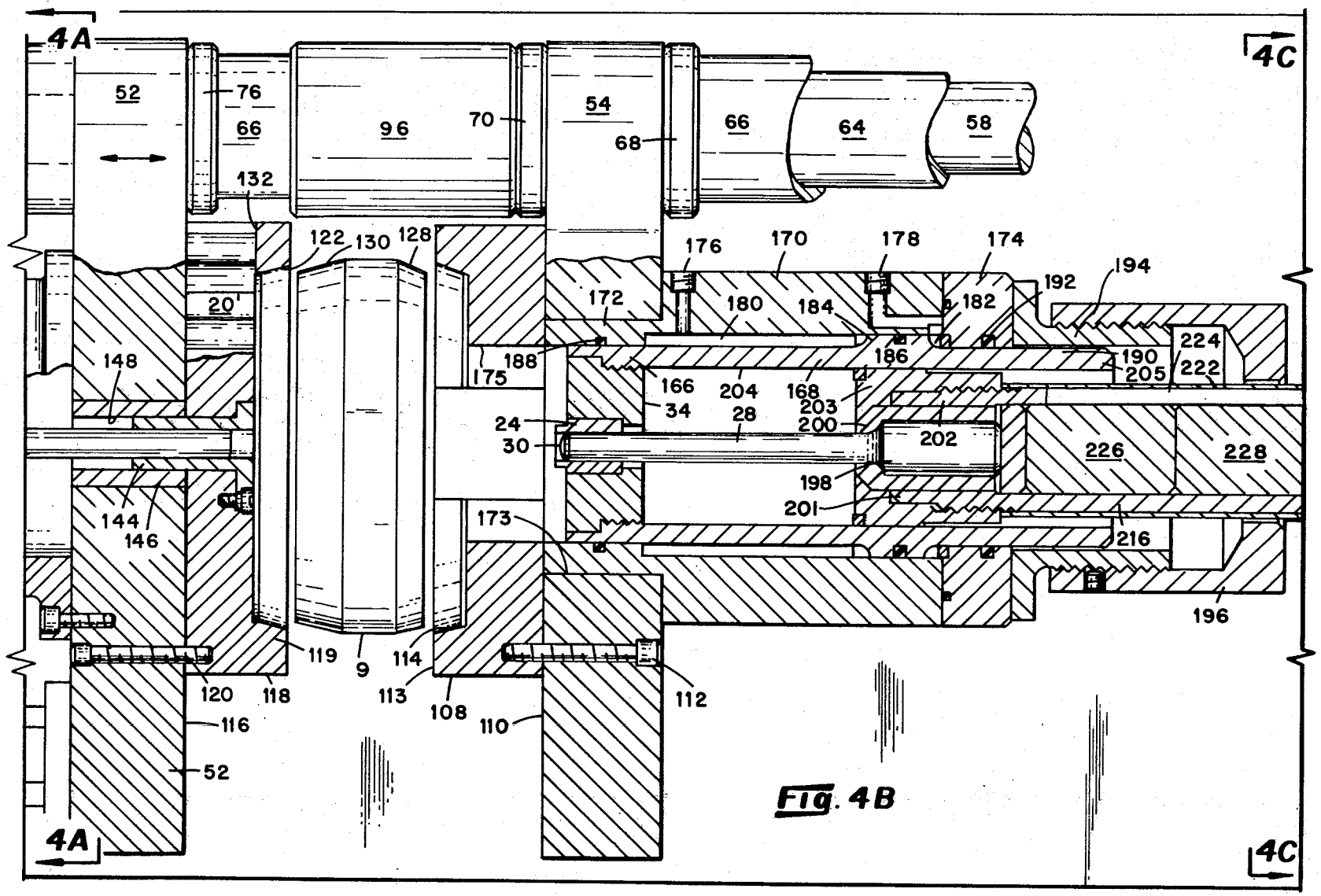
Figure 4C:
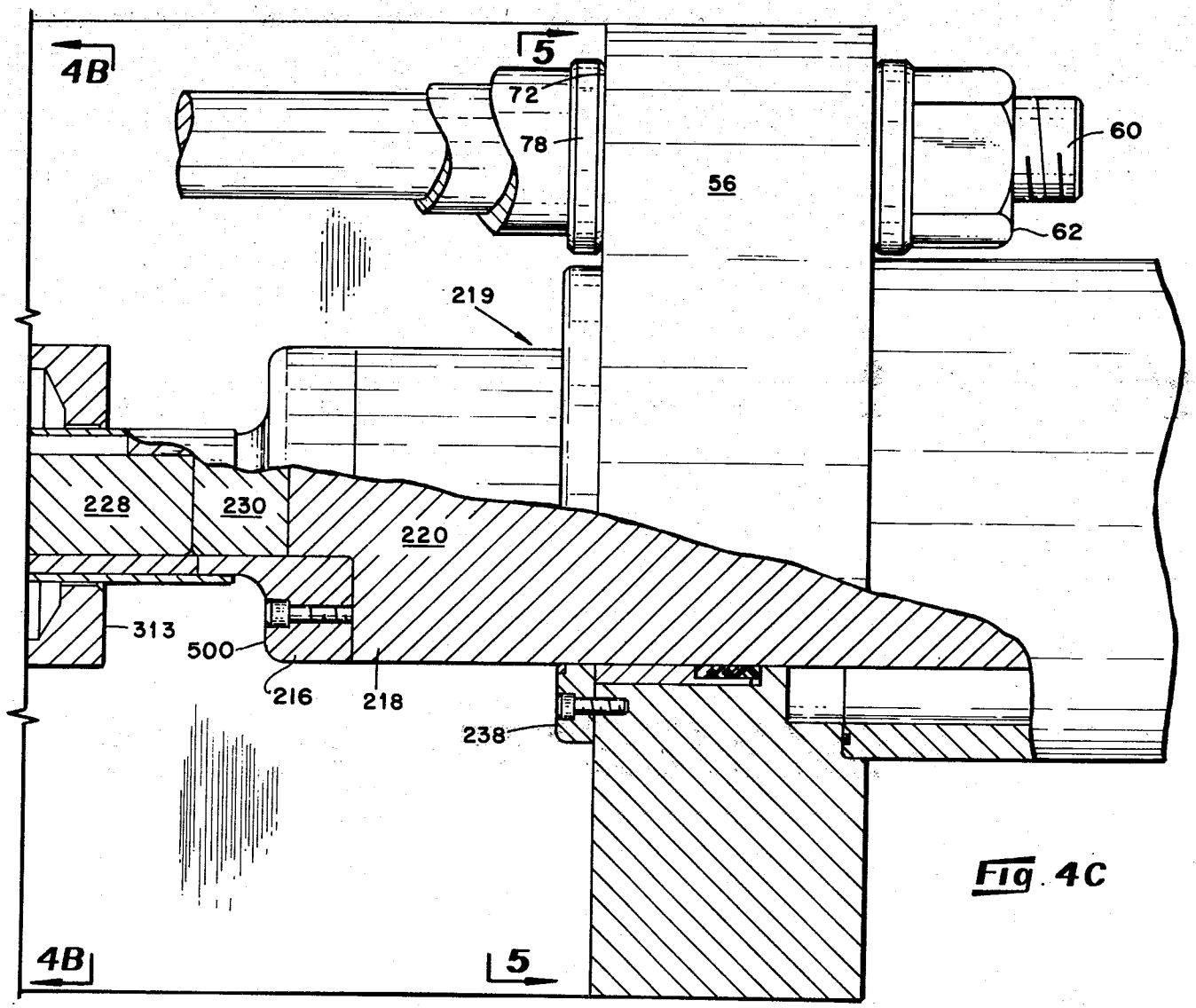
Figure 7:
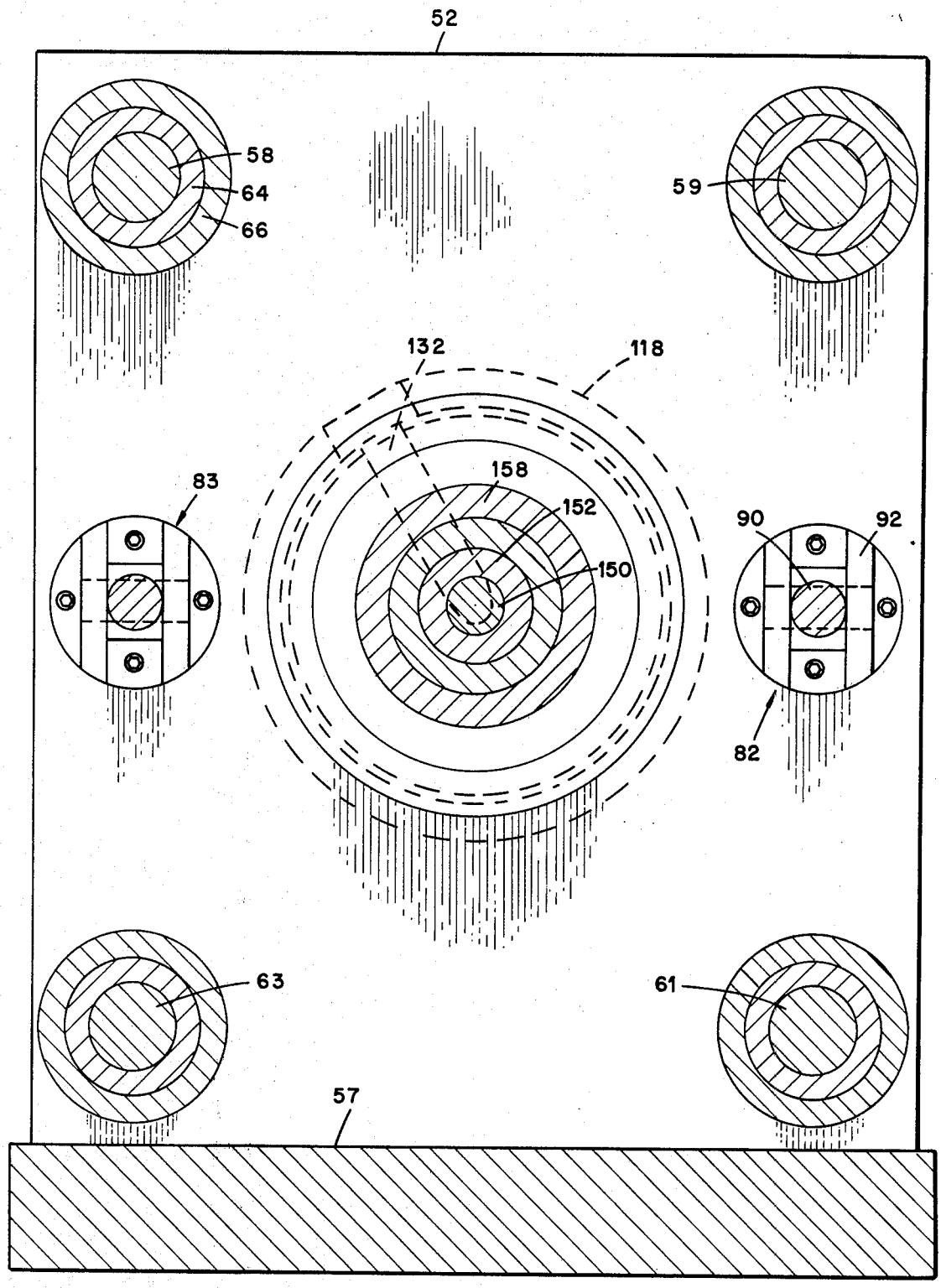
FIG. 7 is a sectional view taken generally along the line 7—7 of FIG. 4*a;*

In FIGS. 4*a*, 4*b* and 4*c*, there is depicted one embodiment of apparatus for carrying out the disclosed method. The view of FIGS. 4*a*, 4*b* and 4*c* is looking down on the top of the apparatus and shows a plurality of plates 50, 52, 54 and 56 adapted to be supported on a suitable means such as a frame means 57 (See FIG. 7). The plates 50, 52, 54 and 56 preferably are rectangular in form and are oriented in upright planes that are substantially parallel one to another, with the interconnection between the plates established and maintained by a plurality of rod members 58, 59, 61 and 63 (see FIG. 7) that are received in registered openings through the thickness of the respective corners of the plates. Only rod 58 is shown in FIGS. 4*a*–4*c* but will be immediately recognized from FIG. 7 that substantially identical rods 59, 61 and 63 are provided at each of the opposite corners of the rectangular plates. Rod 58 is typical of each such rod and a description of rod 58 will suffice for an understanding of the construction and function of each of the rods. In the depicted embodiment the end 60 of the rod 58 projects through the end plate 56 and is externally threaded for receipt of an appropriate nut 62 thereon. The rod 58 is provided with a first concentric bearing member 64 that extends substantially the full length of the rod 58 between the end plates 50 and 56, these concentric members passing through the thickness of the intermediate plates 52 and 54. The end of the rod 58 opposite the end 60 (such opposite end not being shown) projects through plate 50 in like manner as the end 60 projects through the plate 56, and is threaded to receive a nut like the nut 62 on end 60 of the rod 58.

The apparatus is assembled by inserting rods 58, 59, 61 and 63 through the four corners of the rectangular plates 50, 52, 54 and 56 with the concentric tubular member 64 passing through the plates 52 and 54 and having its respective opposite ends terminating adjacent the inboard side 72 of the plate 56 and the inboard side 74 of the plate 50 to thereby establish and fix the minimum lateral spatial relationship between the end plates 50 and 56. With the rod 58 and its concentric member 64 in position, the nuts on the opposite ends of the rod 58 are tightened to force the end plates 50 and 56 against the ends of the member 64 to place the rods 58, 59, 61 and 63 in tension to lock the assemblage together.

A tubular sleeve 66 is disposed about the bearing member 64 in the space between the plates 54 and 56 with washers 68 and 78 being interposed between the ends of the sleeve 66 and the plates 54 and 56. This sleeve 66, and its counterparts associated with the rods 59, 61 and 63, establish the minimum spacing between the plates 54 and 56.

The plate 52 is slidable on the member 64. The right hand limit of movement of the plate 52 along the member 64 is limited by a tubular sleeve 96 that encompasses the bearing member 64 in the space between the plates 52 and 54. Washers 70 and 76 are interposed between the ends of the sleeve 96 and the plates 52 and 54.

As noted, the plate 52 is slidable along the tubular bearing member 64 relative to the fixed end plate 50. To this end, a sliding tubular bushing 102 is provided on the bearing member 64 and receives the plate 52 at one of its corners as noted above. Like sliding bushings are provided at the other corners of the plate 52 (see FIG. 7). This sliding movement of the plate 52 provides for opening of the means which holds the tool stack 9 in position and is accomplished in the depicted embodiment by piston cylinder devices 82 and 83, only 82 being shown in FIG. 4*a*. The cylinder portion 84 of the piston cylinder device 82 is attached to the inboard side 74 of the plate 50 by a rod eye 88 attached at one of its ends to the cylinder 84 and pivotally secured at its opposite end to a clevis 86 mounted on the end plate 50. The piston rod 90 of the piston cylinder device 82 is pivotally connected through a clevis 92 to one side 94 of the plate 52. Preferably, the second piston cylinder unit 83 is provided on the opposite side of the apparatus so that an evenly applied force is available to change the position of the plate 52 relative to plate 50. As noted, this movement of plate 52 provides for opening of the apparatus for tool change and/or maintenance purposes. When plate 52 is moved to the right as viewed in FIG. 6, the tool stack is clamped in position for an extrusion operation.

When the plate 52 is moved to its extreme right hand position (i.e. the apparatus is closed for an extrusion operation) there is provided one or more spacer sleeves 100 in encompassing relationship with the tubular member 64 in the space between the plates 50 and 52. One or more of these spacer sleeves, or additional ones, as required, is made removable so that when it is desired to move the plate 52 to the open position, i.e. in the left hand direction in FIGS. 4*a* and 4*b*, there is provided available space along the member 64 within which the plate 52 can be moved. The same detachable sleeve is replaced when the plate 52 is in the closed position.

As seen in FIG. 4*b*, the intermediate plate 54 is provided with a detachable first die stack holder 108 on its face 110, the holder being releasably secured to the face 110 as by bolts 112. This holder 108 is provided with a recess 114 on its exposed face 113. On the face 116 of the plate 52 and in facing relationship to the holder 108, there is provided a second die stack holder 118 which is releasably secured to the plate 52 as by bolts 120. The exposed face 119 of the second holder 118 is provided with a recess 122 that faces the recess 114 in the holder 108. The tool stack 9 comprising the die nib 10 and shrink rings 12 and 126 (see FIGS. 1 and 6) is removably received between the holders 108 and 118. To this end, the outermost surface of the shrink ring 126 is provided with angled lands 128 and 130 adapted to be received in mating engagement within the recesses 114 and 122, respectively. Notably, the land 128 is of a different angular construction as land 130 and the geometry of the recesses 114 and 122 are selected to receive only their specifically angled land, so that it is virtually impossible to insert the tool stack in the apparatus in an incorrect or reverse position. Still further, the angled relationship between the recess 114 and the cooperating land 128, and the recess 122 and the cooperating land 130 provide for accurate alignment of the tool stack within the recesses, hence accurate parallel alignment of the tool stack with respect to the plates 52 and 54. Still further, the angular relationships between the recesses and the respective lands on the die assembly establish precise concentricity of the tool stack with respect to the remaining elements of the tooling as will appear further hereinafter.

The holder 118 is further provided with a channel 132 defining a magazine for receiving a plurality of billets 20' in position for feeding into the die 10. These billets may be fed into the magazine by any suitable means such as are well known in the art.

As referred to hereinabove, the depicted die nib 10 is provided with a cavity extending through the thickness of the die nib and open at both of its ends. In accordance with the present disclosure, the cavity is provided with a first cylindrical section 136 of substantially uniform cross-section along its length and a second section 138 having a cross-section larger than the cross-section of the section 136. In the preferred embodiment, the section 138 is of relatively short length compared to the length of the section 136.

Figure 6:
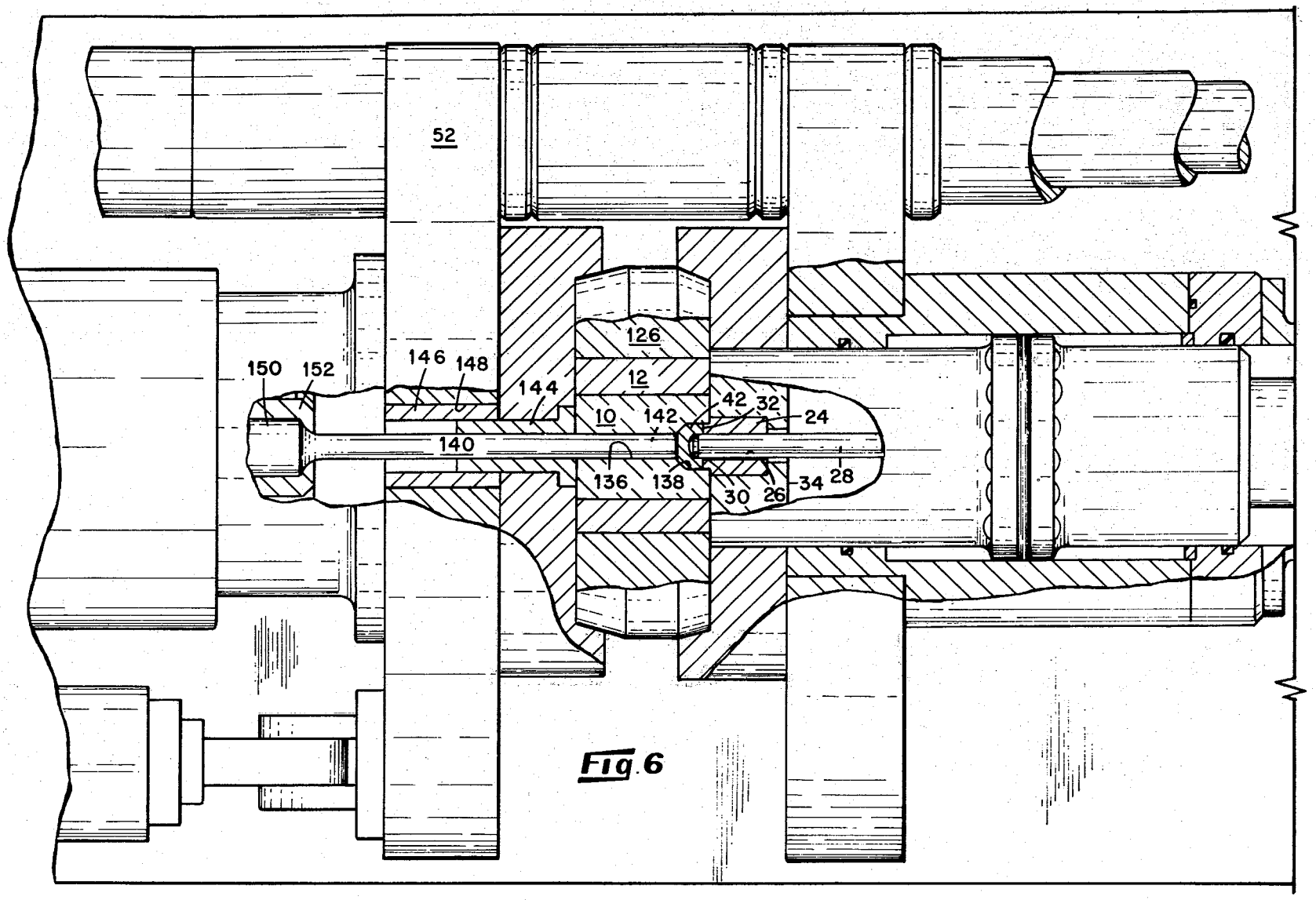
FIG. 6 is a fragmentary top view, partly cutaway and partly in section, showing the apparatus depicted in FIG. 4*b* in a closed position for carrying out an extrusion operation.

In the embodiment depicted in FIGS. 4b and 6, the apparatus is provided with a ram 140 having its outboard end 142 reciprocatably received within the die cavity section 136. The ram 140 is supported outside the die cavity by a sleeve 144 mounted in the annular plate 118 and extending therefrom to be received in an opening 148 extending through the thickness of the plate 52. Within the plate 52, the sleeve 144 is received in a further sleeve 146 which in turn fits in an opening 148 that extends through the thickness of the plate 52. Thus, the concentricity of the ram 140 is maintained with respect to the annular plate 118, the tool stack 9, and the plate 52. The exposed end of the ram 140 is formed to an enlarged piston head 150 which is in turn substantially surrounded by a collet 152 which is in turn housed within the externally threaded end 153 of a tool holder 154. The end 153 of the tool holder 154 is capped by an internally threaded cap 156 that is slidably received within a hollow cylindrical ram support 158 that is in turn detachably secured to the plate 52 as by bolts 160. By this means, the piston head 150 of the ram 18 is slidably supported in axial alignment with the die cavity 14. The support 158 is externally threaded on its outboard end to receive a threaded cap 162 having a rear face 159 that serves as an abutment for selectively adjusting the limit of travel of the ram 18 toward its retracted position, i.e. to the left as viewed in FIG. 4a.

The enlarged section 138 of the die cavity 10 is adapted to matingly receive therein the reduced diameter annular shoulder 32 on the end of the power pad bushing 24 facing the die cavity. As noted above, the power pad 24 is provided with an internal bore 26 within which there is reciprocatably received the anvil 28. In the depicted embodiment, when the leading end 30 of the anvil is in its forward position (to the left as viewed in FIG. 6), the end 30 of the anvil projects from the power pad 24 into the cavity section 138. In this position, there is defined between the end 30 of the anvil and the wall of the cavity section 138, an annular space 42.

Also, as noted before, the power pad 24 is carried in an annular collar 34 which, as shown in FIG. 4b, is threadably mounted in the end 166 of a hollow cylindrical piston 168 which is in turn reciprocatably received within a housing 170 having a reduced diameter end 172 mounted in the plate 54. The internal diameter of the reduced diameter end 172 of the housing 170 is in axial alignment with, a central bore 173 through the thickness of the plate 54, and a central bore 175 through the tool stack holder 108 so that the piston 168 is reciprocatable with these aligned bores. The opposite end of the housing 170 is closed by a cap 174. Ports 176 and 178 in the housing 170 are provided for the movement of hydraulic fluid into annular spaces 180 and 182, respectively, on opposite sides of an enlarged section 184 of the piston 168, such enlarged section being sealed with respect to the housing 170 as by a seal 186. The end 166 of the piston 168 is similarly sealed by seal 188 with respect to the end 172 of the housing 170. The opposite end 190 of the piston 168 is sealed with respect to the cap 174 by a seal 192.

The cap 174 is further provided on its exposed end with a flange nut 194 which in turn receives an internally threaded annular abutment member 196 that serves as an adjustable limit for the retraction movement of the anvil 28 as will appear further hereinafter.

The outboard end of the anvil 28 is enlarged to define a piston head 198. This piston head is mounted in a collett 200 which is in turn received in an externally threaded end 201 of a cylindrical tool holder 202. The end 201 of the tool holder 202 is encircled by an internally threaded sleeve member 203 which is in turn slidably received within an axial bore 204 provided in the piston 168 such that the anvil 28 is axially movable relative to the piston 168 and to the power pad 24 which aids in maintaining the end 30 of the piston 28 concentrically of the piston 168.

The tool holder 202 comprises a generally cylindrical hollow central section 216 which projects out of the rear end 205 of the hollow piston 168 to be detachably received on the forward end 218 of a piston 220. The tool holder is further provided with an elongated slot 224 along one of its sides. A cover 222 for the tool holder is slidably positioned in encircling relationship with the central section 216 of the tool holder 202. This cover 222 is provided with an appropriate opening such that upon rotation of the cover, the opening in the cover can be caused to come into register with the slot 224 to expose the interior of the hollow tool holder. Within the hollow interior of the tool holder 202, there is provided a plurality of spacers 226, 228 and 230. When it is desired to remove the anvil or exchange it for a different size tooling or to change the relative position of the anvil with respect to the piston 220, the spacers 226, 228 and 230 or selected ones of these may be removed and a spacer of different length substituted therefore, these spacers being removed through the slot 224 and the registered opening in the cover 222.

Figure 5:
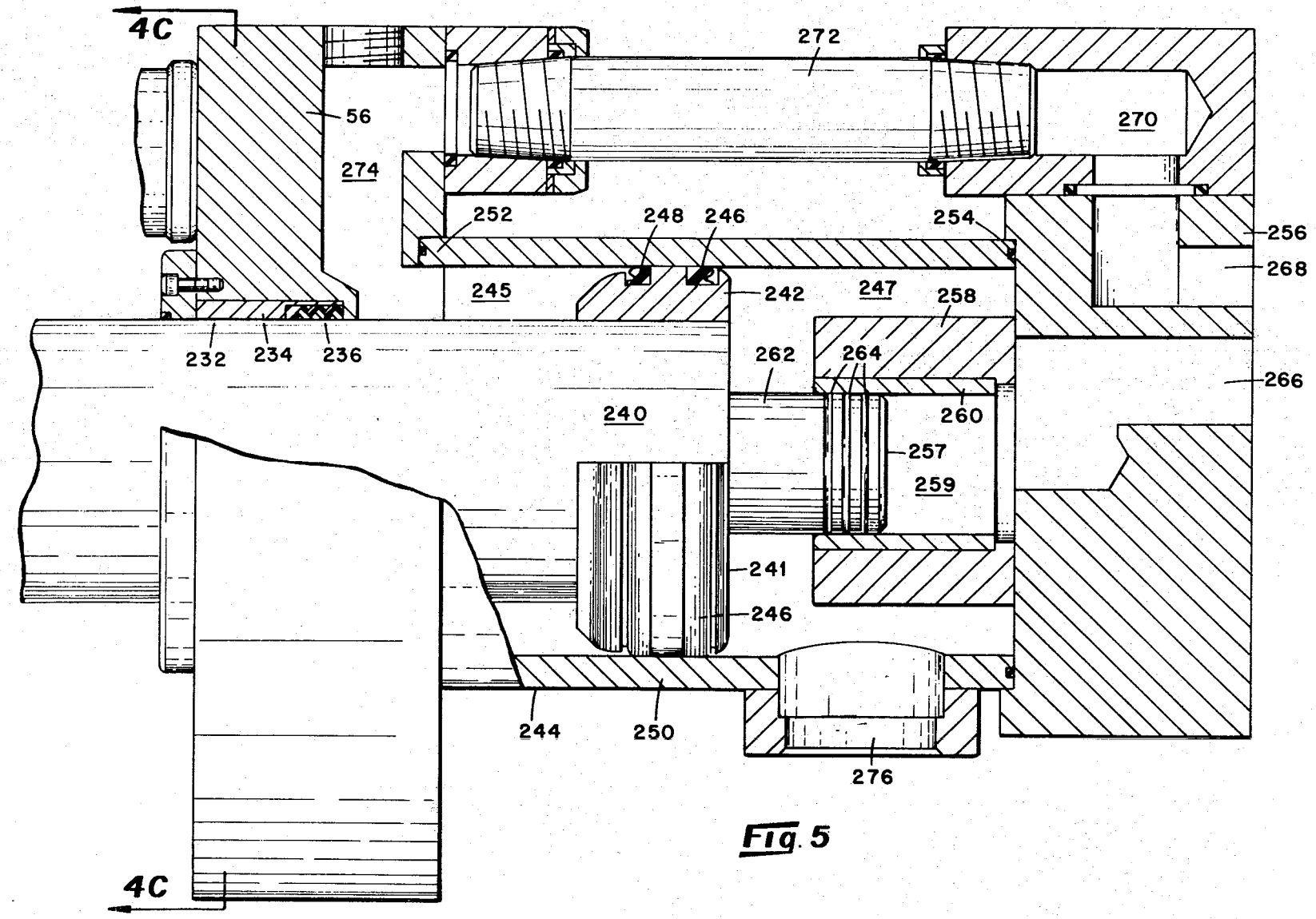
FIG. 5 is a fragmentary top view, part in section and part cutaway, of the right hand end of the apparatus shown in FIG. 4*c;*

As shown in FIG. 4*c* and FIG. 5, the power for advancing or retracting the anvil 28 is provided by means of a piston-cylinder assembly 219 mounted in the plate 56. As seen in FIG. 5, the plate 56 is provided with a central opening 232 through the central thickness thereof. This opening is further provided with a bushing 234 that encircles a piston 220 which extends through the opening 232. Chevron seals 236 provide an appropriate seal for sliding action of the piston through the plate 56. A seal ring 238 is provided on the face 72 of the plate 56 in encircling relationship with the piston 220. The rear end 240 of the piston 220 is provided with piston head member 242 which is slidably mounted within a hollow cylinder 244 with a sliding seal therebetween being affected by seals 246 and 248. In this manner, the hollow cylinder 244 is divided into two expandable chambers 245 and 247, one on each of the opposite sides of the piston head 242.

The cylinder 244 comprises a cylindrical housing 250 which has one of its ends 252 mounted in the plate 56. The housing 250 extends from the plate 56 rearwardly (to the right in FIG. 5) and is closed at its rear end 254 by a plate 256. Internally of the end 254 of the cylinder 244, there is provided a further hollow cylinder 258 disposed concentrically of and in axial alignment with the cylinder 244 and defining a chamber 259. This cylinder 258 is further provided with a cylindrical bushing 260 within which there is received a reduced diameter piston section 262 that projects rearwardly from the piston 220 to be slidably received within the bushing 260. Seals 264 encircle the piston section 262 and provide for sealing engagement between the outer surface of the piston section 262 and the bushing 260.

The plate 256 is provided with a first port 266 which is in fluid communication with the chamber 259 such that hydraulic pressure applied through port 266 serves to pressurize the chamber 259 and urge the piston section 262 to the left of FIG. 5. The plate 256 is provided with a further port 268 which is in fluid communication through passageway 270, conduit 272, and passageway 274 to the chamber 245 of cylinder 244 on the left hand side of the piston head 242 as is seen in FIG. 5. A further port 276 of substantially enlarged opening is provided in the wall of the cylinder 244 at a location rearwardly (to the right in FIG. 5) of the most rearward position of the piston head 242 and in fluid communication with the chamber 247 of the cylinder 244.

Power for reciprocating movement of the ram 18 (on the end of the apparatus opposite anvil 28) is provided by apparatus substantially identical to the apparatus hereinabove described in connection with the reciprocating movement of the anvil 28 so that the foregoing description of the piston-cylinder apparatus that accomplishes reciprocating movement of the anvil 28 is sufficient for an understanding of the apparatus that provides for reciprocating movement of the ram 18. In FIG. 4*a*, that portion of the apparatus shown which corresponds to equivalent apparatus in FIGS. 4*c* and FIG. 5 is indicated by numerals having a prime.

Figure 8:
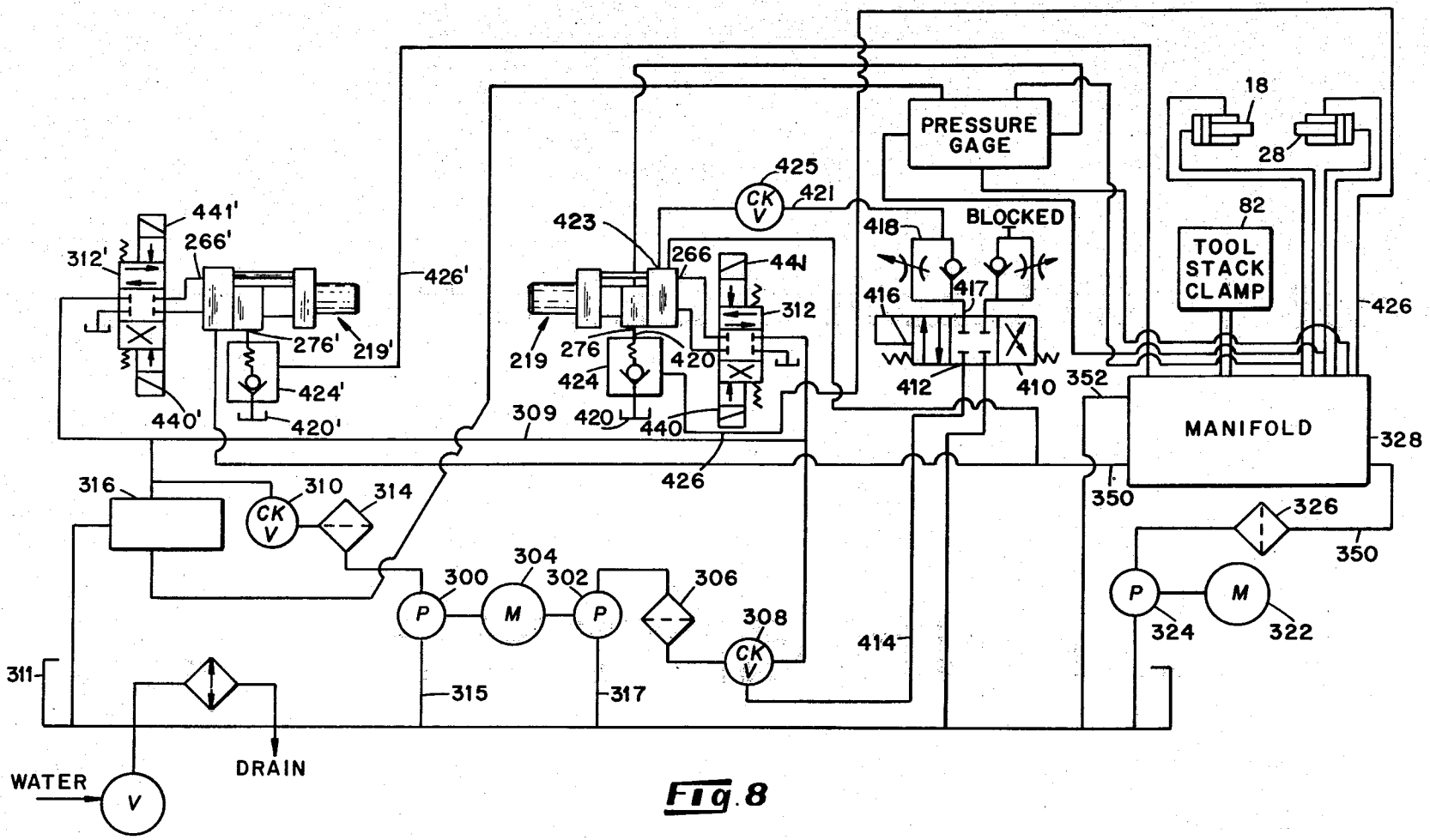
FIG. 8 is a schematic representation of a hydraulic control system for controlling the apparatus of the present invention.

A schematic representation of a hydraulic control circuit for providing programmed power for actuation of the various working elements of the present apparatus is shown in FIG. 8. Generally, the several working components of the present apparatus are powered by pressurized hydraulic fluid supplied by way of a main hydraulic circuit that provides relatively high pressure, and a secondary hydraulic circuit that provides relatively low pressure. In the main hydraulic circuit of the depicted embodiment, pumps 300 and 302, which are driven by a motor 304, provide pressurized hydraulic fluid that is conveyed through respective filters 306 and 314, through respective check valves 308 and 310 to a manifold conduit 309. The conduit 309 is connected in fluid communication with a first directional control valve 312 associated with the piston cylinder apparatus 219 which provides motive power for the anvil 28. The conduit 309 is further connected to a second directional control valve 312' that is associated with the piston cylinder assembly 219' which provides motive power for reciprocating movement of the ram 18.

The hydraulic fluid in the main circuit is returned to a reservoir 311 via a conventional pressure relief valve and check valve assembly 316. The pumps 300 and 302 draw hydraulic fluid from the reservoir 311 through respective conduits 315 and 317. The pressurized hydraulic fluid in the main circuit provides driving force for the pistons 220 and 220' to advance the ram 18 and/or the anvil 28 and/or hold either stationary against an extrusion pressure.

In the automatic operation mode, it is desired that the piston 220 be provided with a fast forward travel until the anvil 28 has approached its position for the extrusion operation. As the anvil 28 approaches its extrusion position, it is desired that the forward motion be slowed considerably and that the movement of the anvil 28 into its final extrusion position be at a relatively slow rate. In the depicted embodiment, this dual rate of movement of the piston 220 is accomplished by first introducing pressurized hydraulic fluid into the chamber 259 to the rear of the reduced diameter piston section 262. The application of this pressurized fluid to the rear face 257 of the piston section 262 provides for fast forward movement of the piston 220, until the piston section 262 has moved completely out of the chamber 259. Thereupon, the pressurized fluid is released into the much larger interior chamber 247 within the cylinder 244 on the rear side of the piston head 242. At this point in time, the anvil 28 is approaching its extrusion position. By reason of the relatively larger surface area on the rear face 241 of the piston head 242, the pressurized hydraulic fluid admitted to the chamber 247 causes the piston 220 to move forward relatively slowly until the anvil has achieved its extrusion position. The forward movement of the anvil is halted by the forward face 500 of the tool holder 216, which is attached to the piston 220, engaging the rear face 313 of the anvil stop 196 (see FIG. 4*c*).

The pressure developed by the pumps 300 and 302 is deemed the high pressure portion of the hydraulic system, the pressure anticipated being approximately 3000 pounds per square inch (psi) which develops a working pressure of about 75 tons. It will be recognized that other similar relatively high pressures may be utilized depending upon the circumstances of the extrusion operation.

The secondary hydraulic circuit comprising a lesser pressure, i.e. to about 1500 psi, is also shown in FIG. 8. This secondary hydraulic circuit comprises a motor 322 which drives a pump 324 from which hydraulic fluid is conveyed through a filter 326 to a manifold 328.

The pressure in the secondary hydraulic circuit serves multiple functions including providing a pilot pressure utilized in operating certain of the control valves employed in the hydraulic circuits of the control system. The pressurized hydraulic fluid from the secondary system is also utilized in operating the power pad assembly, and for opening and closing the tool stack clamping mechanism.

Specifically, the pressurized hydraulic fluid from the pump 324 is conveyed through a filter 326, and through a conduit 350 to the manifold 328 which includes a return line 352 from which the hydraulic fluid returns to the reservoir 311 hence to the pump 324 to complete the circuit. Within the manifold 328, there is provided a pressure relief valve 354 connected across the conduits 350 and 352 and by means of which the maximum pressure obtaining within the secondary circuit is regulated.

Figure 9:
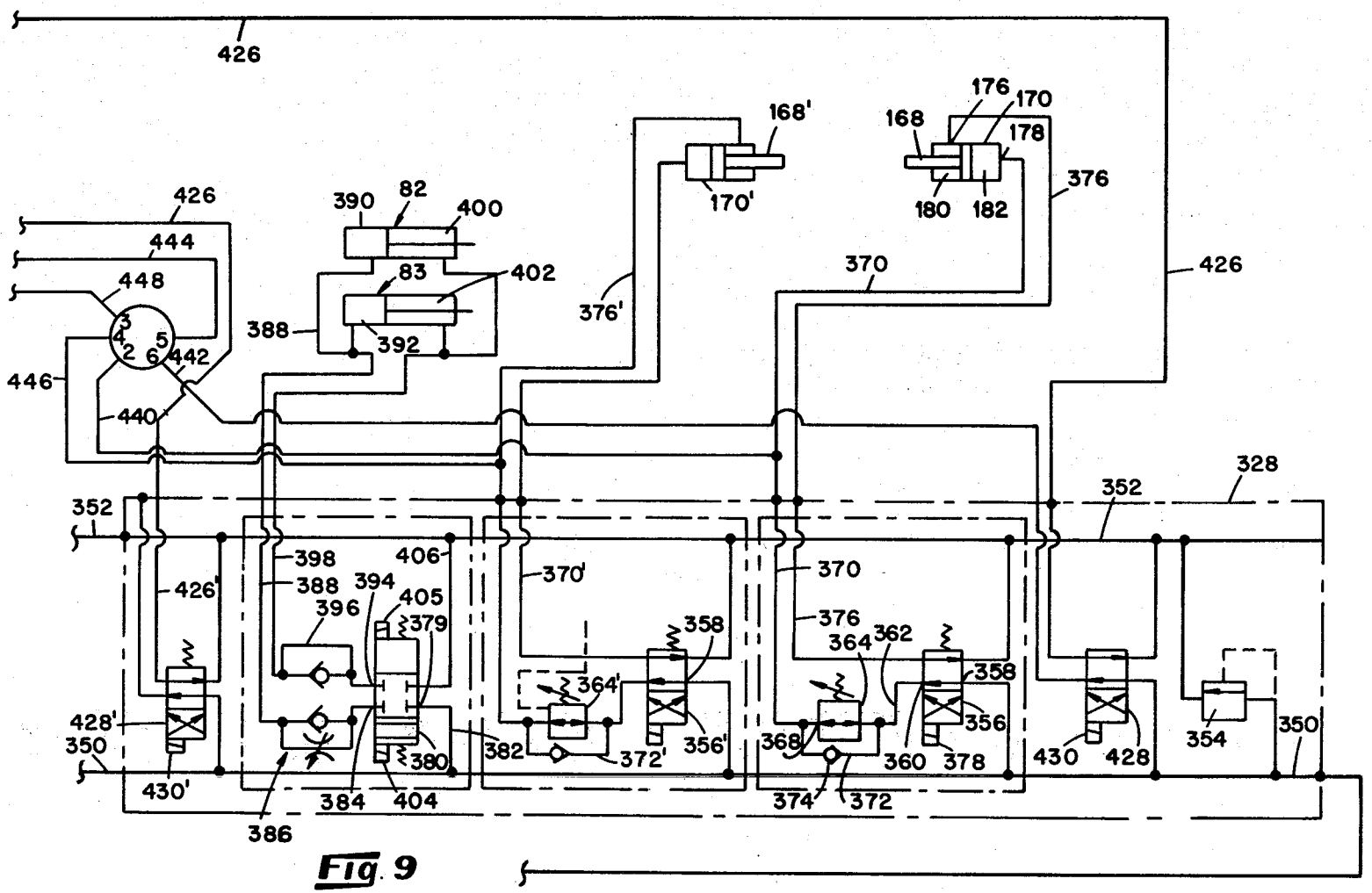
FIG. 9 is a detailed schematic representation of a portion of the control system shown in FIG. 8.
Figure 10:
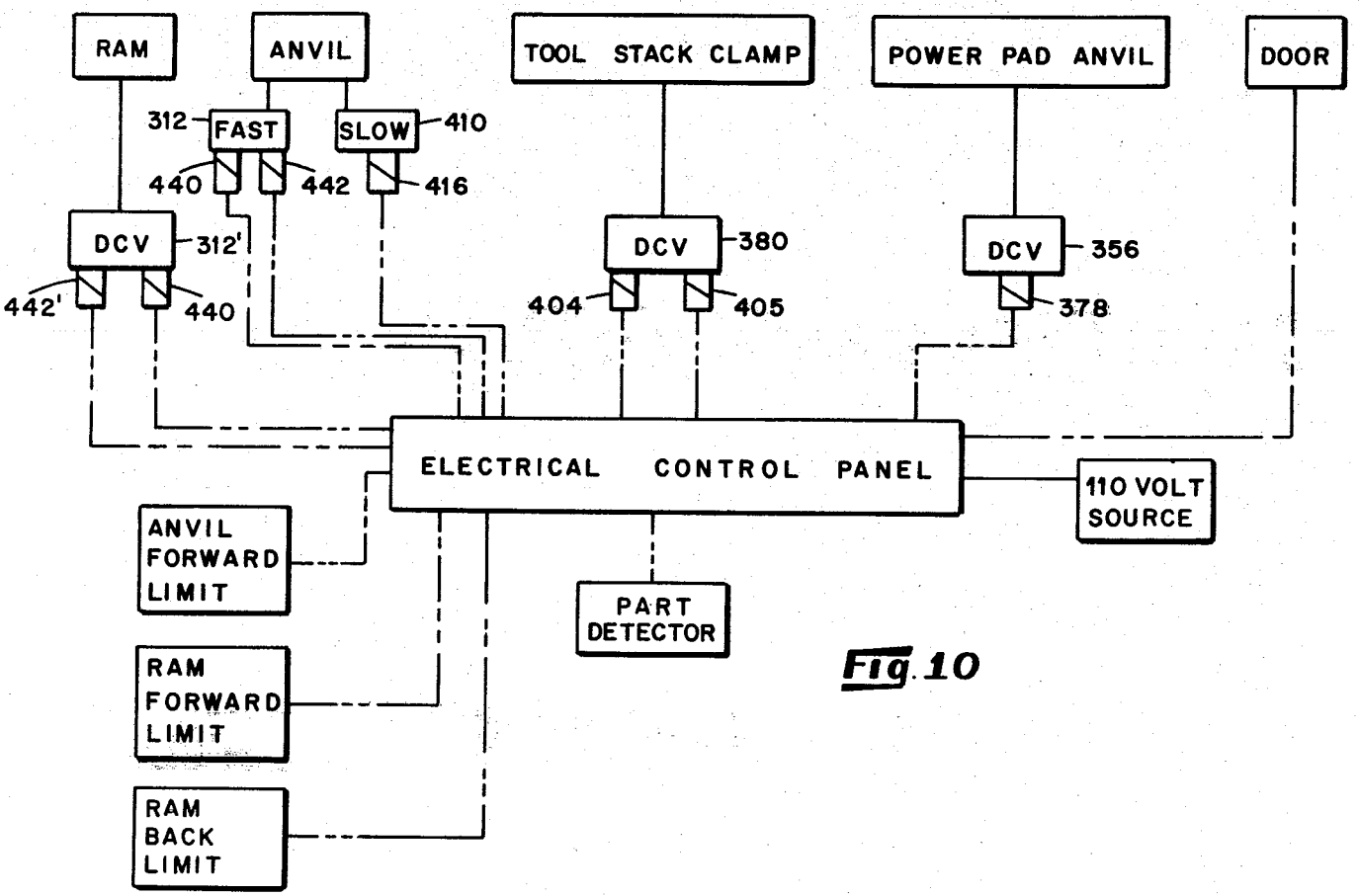
FIG. 10 is a block diagram of an electrical control system for use in controlling the operation of the apparatus of this invention.

Referring to FIG. 9, to supply pressurized hydraulic fluid to the chambers 180 and 182 of the cylinder 170 for reciprocating movement of the power pad 24, there is provided in the manifold 328 a directional control valve 356 having its inlet 358 connected to the conduit 350. The outlet 360 of this directional control valve is fed through a conduit 362 to a pressure relief valve 364. The outlet 368 from this pressure relief valve 364 is fed through a conduit 370 to the port 178 in the cylinder 170 for providing a force urging the power pad toward its position of engagement with the die nib 10. It is noted that the pressure relief valve 364 is manually regulated and includes a bypass 372 that incorporates a check valve 374. Importantly, when during an extrusion operation there is a force applied against the power pad by reason of the extrusion, there occurs a pressure buildup within the chamber 182 on the rear side of the piston 168. This buildup in pressure is transmitted by the conduit 370 to the pressure relief valve 364. Inasmuch as the check valve 374 prevents a reverse flow of hydraulic fluid around the bypass 372, the flow of hydraulic fluid out of the chamber 182 behind the piston 168 is regulated by the setting of the pressure relief valve 364. Thus, by choosing the setting of the pressure relief valve, one is able to establish that pressure which will be developed to maintain the power pad against the force of the extrusion operation. As will be recognized hereinafter, this pressure is chosen to be sufficient to exert an opposing force against the extruding part that will rigidify the extruding part relative to the tool stack, the plate 54, etc., such that the part provides lateral support for the anvil 28 as the power pad 24 is moved rearwardly with the extruding metal. Power for returning the power pad to its rearward position upon the completion of an extrusion operation is provided by pressurized hydraulic fluid introduced to the forward chamber 180 of the cylinder 170 through conduit 376 which is valved into fluid communication with the conduit 350 by the directional control valve 356. A solenoid 378 provides the means for adjusting valve 356 in selecting the direction of flow of fluid through the valve 356.

Whereas the specific embodiment of the apparatus shown in FIGS. 4*a, b,* and *c* does not include a power pad on the ram side of the die nib 10, it is noted that FIGS. 8 and 9 show the manner in which such a power pad 24' can be provided and controlled. Basically, the control of the power pad on the ram side is substantially identical to the control of the power pad on the anvil side so that the description of the hydraulic circuitry for controlling the power pad on the anvil side will be sufficient for an understanding of the manner in which the power pad on the ram side is controlled. Equivalent elements of the control system for the power pad on the ram side are identified by primed numerals.

As noted above, opening and closing of the tool stack clamping mechanism is also controlled from the secondary hydraulic circuit. Referring specifically to FIG. 9, the input port 379 of a direction control valve 380 is connected by way of a conduit 382 to the manifold conduit 350. The output 384 of this directional control valve is connected through a regulated check valve 386 and conduit 388 to the rear chambers 390 and 392 of the piston-cylinder members 82 and 83 which, as referred to above, provide for movement of plate 52 to open and close the tool stack clamping assembly. The output port 394 of the directional control valve 380 is connected in fluid communication through a regulated check valve 396 and conduit 398 to the forward chambers 400 and 402 of the piston cylinder members 82 and 83. Thus, by means of the directional control valve 380, the opening and closing of the tool stack clamping assembly is accomplished by selecting the directional flow of the pressurized hydraulic fluid through the valve 380. Solenoids 404 and 405 provided on the valve 380 serve to control the functioning of the valve 380. To complete the circuit, the directional control valve 380 is connected through an output conduit 406 to the return line 352.

As noted hereinbefore, in the movement of the anvil 28, it is desired that the anvil 28 initially be moved rapidly forwardly toward its extrusion position but that the movement of the anvil 28 be slowed just prior to its reaching its final position for the extrusion operation. As further noted above, the rapid forward movement of the anvil 28 is provided by the introduction of pressurized hydraulic fluid, for example, 3000 psi to the chamber 259 within the cylinder 258 by way of the valve 312. This latter valve 312 is of the double solenoid, spring centered, blocked port type and by reason of its size is relatively slow in its operation. For example, after the anvil 28 has reached its forward limit of travel, it is desired that the valve 312 be closed, i.e. shifted to its "blocked port" stage, to hold the pressure in the chamber 247 and thus hold the anvil in a stationary position during an extrusion. However, the relatively slow operation of the valve 312 results in a slight, but undesirable delay between the time the anvil is positioned and the commencement of an extrusion. Moreover, any leakage past the valve 312 can result in rearward movement of the anvil and disruption of the extrusion. Therefore, in the hydraulic circuitry shown in FIG. 8, there is also provided a slow forward control circuit which at all times during an extrusion cycle, maintains the pressure (using lower flow rates) within the chamber 247. This circuitry includes a directional control throttle valve 410 having its inlet 412 connected to the main hydraulic circuit via a conduit 414. This directional control valve is actuated as by a solenoid 416. The output 417 of the directional control valve 410 is connected through a throttle valve 418 and conduit 421 and to port 423 to the interior of the chamber 247 on the reverse side of the piston head 242. A check valve 425 interposed in the conduit 421 prevents reverse flow of fluid through this conduit. In the disclosed system, the directional control valve 410 is activated initially with the introduction of pressurized fluid through the port 266 to the chamber 259 of cylinder 258 and remains activated until the end of a cycle. In this manner, there is continually supplied to the chamber 247 pressurized fluid adequate to effect slow forward movement of the anvil 28 and to maintain anvil 28 in its position, regardless of the speed of operation of valve 312. It will be recognized, however, that this slow forward movement of the anvil 28 is overridden initially by the effect of the pressurized fluid within the chamber 259 of the cylinder 258 until the piston section 262 has cleared chamber 259.

In connection with the fast forward movement of the piston 220, it is noted that as the piston 220 is moved rapidly forwardly by the pressurized fluid in the chamber 259, there is a rapidly increasing volume change within the chamber 247. This rapid change in volume size of the chamber 247 develops a "vacuum" which would negate the desired rapid forward movement of the piston 220 in the absence of provision for accommodating such volume change. The present inventors accommodate this volume change by connecting the chamber 247 through the port 276 to a reverse hydraulic fluid tank 420 which provides a supply of hydraulic fluid for flooding the chamber 247 without significant resistance to forward movement of the piston 220. To this end, the port 276 is relatively large. The connection between the port 276 and the tank 420 is effected as by a conduit 422 having a check valve 424 interposed therein which permits flow of hydraulic fluid toward the chamber 247 and only allows flow outwardly from the chamber 247 when the check valve is overridden. It will be further recognized that such outward flow of hydraulic fluid from the chamber 247 is desired when the piston 220 is to be moved in a rearwardly direction. Override of the check valve 424 to permit such outflow is accomplished by hydraulic pressure applied to the check valve through a conduit 426 connected through a directional control valve 428 connected across the conduits 350 and 352 of the manifold 328. This control valve 428 is activated by a solenoid 430 such that upon an appropriate signal, the directional control valve 428 admits hydraulic fluid through the conduit 426 to the check valve 424 to override the check valve and permit the flow of hydraulic fluid outwardly from the chamber 247 to the tank 420.

Fast forward movement of the ram 18 is accomplished in like manner as fast forward movement of the anvil 28. This is accomplished by the directional control valve 312' which is identical in construction and operation to the directional control valve 312 described above. In addition, there is provided a check valve 424' connected in fluid communication between the chamber 247' on the reverse side of the piston 220' and a hydraulic reservoir 420'. Overriding of the check valve 424' is accomplished by pressurized hydraulic fluid admitted thereto by way of conduit 426' connected to a directional control valve 428' that is activated by a solenoid 430'. The function and operation of the corresponding elements described above as will be recognized by a person skilled in the art.

In a preferred embodiment, the hydraulic control circuit is provided with a visual pressure indicator having multiple positions for providing a visual indication of the pressure at various points in the system. As shown in FIG. 9, position No. 2 is connected by conduit 440 to the conduit 370 to provide an indication of pressure within the chamber 182 of the cylinder 170, thereby indicating the pressure being exerted against an extruding product. Position No. 6 is connected by way of conduit 442 to the output of the directional control valve 428 to provide an indication of the pressure within the secondary hydraulic circuit. Position No. 5 is connected by conduit 444 to the forward chamber 180 in the cylinder 170 to provide an indication of the rearward pressure being applied to the power pad 24. Position No. 4 is connected by conduit 446 to the conduit 376' to provide an indication of the pressure being applied by a power pad on the ram side of the die nib 10 in the event such a power pad is employed. Position No. 3 is connected by conduit 448 to the main hydraulic circuit.

In an operation of the apparatus depicted in the several Figures, a plurality of relatively slender cylindrical billets 20' are loaded into the magzine 132. Upon an appropriate electrical signal, the solenoid 404 is activated to open valve 380 to admit pressurized hydraulic fluid to the chambers 390 and 392 of the piston-cylinder devices 82 and 83 to clamp the die assembly in position between the plates 52 and 54. The tool stack is held in this position until a further signal is directed to solenoid 405 to activate the valve 380 to change the direction of flow of hydraulic fluid through the valve 380 and into the chambers 400 and 402 of the piston-cylinder devices 82 and 83 to open the tool stack clamping assembly.

Once the tool stack is clamped into position, an electrical signal is directed simultaneously to the solenoids 416 and 440. The solenoid 440 opens the valve 312 and admits the pressurized hydraulic fluid through the port 226 to the chamber 259 in cylinder 258, thereby commencing fast forward movement of the anvil 28. As the piston 220 moves forward, the "vacuum" created in the chamber 247 pulls hydraulic fluid from tank 420 and check valve 424 into the chamber 247. Simultaneously, with the opening of valve 312, solenoid 416 open valve 410 to start the flow of pressurized hydraulic fluid from the main hydraulic circuit through valve 410 to the chamber 247. This valve 410 remains open until the anvil bottoms out as noted above. Also, simultaneously with the commencement of the forward movement of the anvil 28, solenoid 378 is activated to open valve 356 to admit pressurized hydraulic fluid through conduit 370 to the chamber 182 on the reverse side of the piston 168 thereby commencing forward movement of the power pad 24. This power pad moves forwardly into contact with the die nib 10 and is held thereagainst by the pressure from the secondary hydraulic circuit as controlled by the valve 364 and its bypass 372. When the power pad contacts the die nib, (or reaches some other point in its motion) an appropriate signal is generated to activate solenoid 440' to start forward movement of the ram 18. It will be recognized that the anvil side of the die cavity 14 is closed by the power pad 24 and the anvil 28. As the ram moves forwardly, its leading end contacts a billet 20 and urges the billet into the die cavity 14. Further forward movement of the ram 18 commences extrusion of the billet, such extrusion continuing until the forward movement of the ram passes an electronic eye, for example whereupon an appropriate electrical signal is developed to activate solenoid 441' to reverse the direction of movement of the ram 18. The signal from the electronic eye that senses the forward limit of travel of the ram 18 is further fed to the solenoid 441, after a time delay of about 30 to 50 milliseconds, to commence reverse movement of the anvil 28. As the reverse movements of the anvil 28 and the ram 18 are commenced, the solenoids 430 and 430' are activated to open the valves 428 and 428' to direct pressurized hydraulic fluid to the check valves 424 and 424' for opening these check valves and allow hydraulic fluid in the chambers 247 and 247' to be dumped into the tanks 420 and 420'. Also, simultaneously with commencement of reverse movement of the anvil 28, an appropriate electrical signal is directed to the solenoid 378 to change the direction of the flow of hydraulic fluid through the valve 356 such that the chamber 180 in the cylinder 170 is pressurized to commence reverse movement of the power pad 24.

As the power pad 24 and the anvil 28 are retracted, the extruded product is withdrawn from the die cavity while still on the anvil 28. The power pad 24 reaches its rear limit of travel when the face 313 on the collar 196 contacts the face 500 of the tool holder 216. The anvil 28 continues its reverse travel, thereby stripping the product from the anvil. The freed product falls by gravity past the detector 46 to develop a signal for commencement of another cycle of operation.

In one type of extrusion employing the disclosed method and apparatus, billets were sheared from A1S1-1008 cold heading quality steel wire. The individual billets were cylindrical, 1.27 inches long, and possessed a diameter of 0.625 inch with a weight of 50 grams. These billets were given a conventional pretreatment, including speroidize-annealling and cleaning, and lubricated with phosphate and molyheleumsulphide powder. The pretreated billets were extruded about the end of a cylindrical anvil having a diameter of 0.662 inch, with the apparatus disclosed herein operating in the automatic mode, at rates of between 30 and 40 extrusions (billets) per minute. This anvil was disposed within a cylindrical die cavity section having a diameter of 0.860 inch so that there was an annular space defined between the anvil of the die cavity of 0.23668 square inches cross-sectional area.

The extruded product of this operation was of a cylindrical cup geometry 2 inches long and having an outside diameter of 0.850 inch and an inside diameter of 0.662 inch, yielding a cross-sectional bore area of 0.344196 square inch ("B" in Eq. 1). The cross-sectional area of the billet before extrusion was 0.306796 square inch ("A" in Eq. 1). Therefore, using Eq. 1, there was a reduction of approximately 112%.

The anvil 28 in this operation was maintained stationary with a pressure of approximately 75 tons while the ram 18 was advanced with the same applied pressure. The power pad 24 was initially positioned in closing relationship with the die nib 10 with a pressure of to about 1500 psi. The pressure relief valve 364 was regulated, i.e. manually adjusted, to permit that flow of hydraulic fluid therepast which under the existing extrusion force resulted in a back pressure of up to about 7.5 tons psi as the extrusion took place. This back pressure initially increased to a relatively large value as the ram moved the billet into contact with the anvil and power pad, and then decreased as the power pad was pushed toward its retracted position by the greater pressure exerted by the extruding billet. In any event, the back pressure exerted by the power pad was sufficiently great to firmly hold the extruding billet in concentric alignment with the anvil, so that the extruded product provided lateral support and alignment for the anvil as the power pad retracted. It will be recognized that during extrusion, the metal of the billet achieves a plastic state substantially only in the annular space between the end of the anvil and the die cavity wall, and that at least a portion of the extruded product solidifies prior to exiting the die cavity so that this end of the extruded product is firmly held in concentric relationship with the die cavity and the anvil.

The tensile strength of the billet averaged about 39,000 psi before extrusion and averaged about 80,000 psi in the extruded product. The yield strength in the billet before extrusion averaged about 24,000 psi, and averaged about 64,000 psi in the extruded product.

Other steel alloys such as A1S1 1018, 1020, and 4027 have been extruded successfully in like manner as described hereinabove.

The complete extrusion described above was accomplished in a single "hit", i.e. one operation cycle of the apparatus in which the billet is deformed only once to obtain the extruded product.

In addition to the usual savings associated with cold extrusion as compared to machining a product from stock metal, the present method and apparatus permit the manufacture of a given product from wire stock, thereby reducing the cost of billets. Further, the present method and apparatus provides for the production of a given extruded product in a single "hit" as compared to the multiple "hits" required heretofore. Still further, the inventors have found that tool breakage is minimal, and almost nonexistent, when using the disclosed method and apparatus.

In addition to the usual forces that operate on the metal in a conventional extrusion, it is theorized by the present inventors that the pressure applied against the metal in opposition to the extrusion pressure puts additional "work" into the metal. The exact effect of this on the flow of the metal is not known, but it appears to be favorable, judging from the improved product. If appears, in any event, that the movement, i.e. flow, of the metal during extrusion is "controlled" in the sense that the metal is not left free to be extruded from the die in an uncontrolled manner as in the prior art, but rather, the metal is allowed to extrude from the die under restraints that have been demonstrated to permit reductions not heretofore obtainable in a single "hit." Notably, the back pressure automatically accommodates for the continually changing dimensions of the product in the course of the extrusion operation.

While a preferred embodiment has been shown and described, it will be understood that there is no intent to limit the invention by such disclosure, but rather, it is intended to cover all modifications and alternate constructions falling within the spirit and scope of the invention as defined in the appended claims. For example, sources of energy other than pressurized hydraulic fluid may be employed. Further, the working pressures employed may be varied to accommodate the required tonnage for working a specific metal or alloy.

What is claimed:

1. A method for providing two-speed movement of a reciprocatory hydraulically driven element of a metal working machine comprising the steps of introducing at respective inlets hydraulic fluid at a first pressure substantially simultaneously into first and second chambers of different cross sectional areas as viewed in a plane that is substantially perpendicular to the direction of reciprocatory motion of said element and which receive therein respective first and second working faces of said element and thereupon cause said chambers to be in fluid communication with one another at a location other than their respective inlets to thereby exert a force against said element to move the same in a direction that tends to move one of said faces out of its respective chamber, while continuing the aforesaid introduction of hydraulic fluid introducing at a separate and larger inlet hydraulic fluid at a second and lesser pressure into that chamber having the larger cross sectional area under flow conditions that tend to equalize the pressure within said chambers when said chambers are not in fluid communication with one another.

2. The method of claim 1 and including the step of stopping the introduction of said hydraulic fluid at said lesser pressure when said chambers are in fluid communication with one another at a location other than at their respective inlets.

3. Apparatus for controlling the movement of a reciprocatory hydraulically driven element of a metal forming machine between extended and retracted positions including first piston means defined by said element, first reservoir means slidably receiving said first piston means therein, said first piston means having a face disposed in fluid communication with said first reservoir means, second reservoir means, second piston means secured to and projecting from said face of said first piston means, said second piston means being slidably received within said second reservoir when said first piston means is substantially retracted and being disposed wholly outside said second reservoir when said first piston is essentially fully extended, said face of said first piston means having a substantially larger working area exposed to said fluid in said first reservoir than the working surface area of said second piston means which is exposed to said fluid in said second reservoir, a source of pressurized hydraulic fluid, means connecting said source of pressurized hydraulic fluid in fluid communication with said first reservoir, means connecting said source of pressurized hydraulic fluid in fluid communication with said second reservoir, a third reservoir, conduit means connecting said third reservoir in fluid communication with said first reservoir, and valve means interposed in said conduit means for controlling the flow of hydraulic fluid between said first and third reservoirs, said valve means comprising a check valve which permits ready flow of hydraulic fluid through said conduit means in a direction from said third reservoir to said first reservoir and said valve means being pilot actuated to selectively permit flow of hydraulic fluid through said conduit means in a direction from said first reservoir to said third reservoir.

4. Apparatus for controlling the movement of a reciprocatory hydraulically driven element of a metal forming machine between extended and retracted positions including first piston means defined by said element, first reservoir means slidably receiving said first piston means therein, said first piston means having a face disposed in fluid communication with said first reservoir means, second reservoir means, second piston means secured to and projecting from said face of said first piston means, said second piston means being slidably received within said second reservoir when said first piston means is substantially retracted and being disposed wholly outside said second reservoir when said first piston is essentially fully extended, said face of said first piston means having a substantially larger working area exposed to said fluid in said first reservoir than the working surface area of said second piston means which is exposed to said fluid in said second reservoir, a source of pressurized hydraulic fluid, means connecting said source of pressurized hydraulic fluid in fluid communication with said first reservoir, means connecting said source of pressurized hydraulic fluid in fluid communication with said second reservoir, a third reservoir, conduit means connecting said third reservoir in fluid communication with said first reservoir, valve means interposed in said conduit means for controlling the flow of hydraulic fluid between said first and third reservoirs, first and second valve means interposed between said source of pressurized hydraulic fluid and said first and second reservoirs, respectively, and means controlling the opening and closing of said first valve means and wherein said first valve means permits a volume of hydraulic fluid to flow from said source of hydraulic fluid into said first cavity at all times except when it is desired to move said first piston means toward its retracted position.

* * * * *